US008746201B2

(12) United States Patent
Springer et al.

(10) Patent No.: US 8,746,201 B2
(45) Date of Patent: Jun. 10, 2014

(54) OIL DRAIN SYSTEM BYPASS

(75) Inventors: Moritz Klaus Springer, Hagen (DE); Hans Guenter Quix, Herzogenrath (DE); Jan Mehring, Köln (DE)

(73) Assignee: Ford Global Technologies, LLC, Dearborn, MI (US)

( * ) Notice: Subject to any disclaimer, the term of this patent is extended or adjusted under 35 U.S.C. 154(b) by 218 days.

(21) Appl. No.: 12/898,327

(22) Filed: Oct. 5, 2010

(65) Prior Publication Data

US 2011/0253092 A1 Oct. 20, 2011

(30) Foreign Application Priority Data

Apr. 15, 2010 (DE) ..... 10-2010-027816

(51) Int. Cl.
*F01M 1/02* (2006.01)
*F01M 1/16* (2006.01)
*F01M 11/02* (2006.01)

(52) U.S. Cl.
USPC ..... 123/196 R; 123/196 AB; 123/41.33; 123/41.44; 123/41.09

(58) Field of Classification Search
USPC ..... 123/41.31, 41.33, 41.85, 41.09
See application file for complete search history.

(56) References Cited

U.S. PATENT DOCUMENTS

| | | | | |
|---|---|---|---|---|
| 1,976,772 | A | 10/1934 | Clarke | |
| 2,525,191 | A | 10/1950 | Warrick et al. | |
| 2,788,176 | A | 4/1957 | Andersen | |
| 2,788,773 | A * | 4/1957 | Meurer | 123/41.35 |
| 4,360,055 | A | 11/1982 | Frost | |
| 4,386,735 | A * | 6/1983 | Tholen et al. | 237/12.3 R |
| 4,393,824 | A * | 7/1983 | Fischer et al. | 123/196 AB |
| 4,556,024 | A | 12/1985 | King et al. | |
| 4,616,609 | A | 10/1986 | Münch et al. | |
| 5,517,959 | A * | 5/1996 | Kato et al. | 123/196 AB |
| 5,575,329 | A | 11/1996 | So et al. | |
| 5,665,242 | A * | 9/1997 | Gallup | 210/696 |
| 6,520,136 | B2 * | 2/2003 | Ito et al. | 123/142.5 R |
| 6,750,763 | B2 * | 6/2004 | Ismail et al. | 340/450.3 |
| 6,941,922 | B2 * | 9/2005 | Williams et al. | 123/196 R |
| 2005/0039719 | A1 | 2/2005 | Moss | |

FOREIGN PATENT DOCUMENTS

| | | | | |
|---|---|---|---|---|
| DE | 32 35 292 | A1 | 3/1984 | |
| DE | 4325141 | A1 | 2/1995 | |
| DE | 102006013867 | A1 | 9/2007 | |
| EP | 1505278 | A2 * | 2/2005 | F02C 7/14 |
| JP | 2003-278519 | A | 10/2003 | |

OTHER PUBLICATIONS

Partial Translation of "Lexikon Motorentechnik 2. Auflage, Der Verbrennungsmotor von A-Z," Wiesbaden: Vieweg & Sohn Verlag, 2006, pp. 872-889.

* cited by examiner

*Primary Examiner* — Lindsay Low
*Assistant Examiner* — Kevin Lathers
(74) *Attorney, Agent, or Firm* — Julia Voutyras; Alleman Hall McCoy Russell & Tuttle LLP

(57) ABSTRACT

A system and method are provided for increasing heating of engine oil during a cold start. In one example, engine oil is returned directly to the oil pump inlet, thus bypassing the sump. In this way, a smaller volume of oil receives more heat and is used for lubricating engine components during a cold start, thus providing reduced friction earlier than otherwise possible.

14 Claims, 3 Drawing Sheets

OIL DRAIN SYSTEM BYPASS

CROSS-REFERENCE TO RELATED APPLICATIONS

This application claims priority to German Patent Application Serial Number 10 2010 027 816.5, titled "INTERNAL COMBUSTION ENGINE WITH OIL CIRCUIT AND METHOD FOR HEATING THE ENGINE OIL OF AN INTERNAL COMBUSTION ENGINE OF SAID TYPE" and filed on Apr. 15, 2010, the entire disclosure of which is hereby incorporated by reference for all purposes.

FIELD

The present description relates to a system for heating engine oil.

BACKGROUND AND SUMMARY

Friction in lubricated engine bearings, such as camshaft bearings, contributes to a vehicle's fuel economy. The friction depends, at least in part, on engine oil viscosity, which is a function of engine oil temperature. Thus, the temperature of the engine oil contributes to the fuel consumption and emissions of the internal combustion engine.

Oil systems may be provided where oil is drawn from a sump and provided to various engine components before being returned to the sump. While various approaches, such as electric heaters and other waste heat recovery mechanisms may be used to provide increased heat to the oil, the inventors herein have recognized that there is still a delay in heating up all of the oil in the system so that sufficiently heated oil is drawn from the sump and delivered to the engine components for lubrication.

As described herein, one approach to address the above issues includes supplying engine oil from a higher pressure oil pump side to reciprocating engine components, where at a first condition, at least some engine oil downstream of the reciprocating engine components is diverted around an oil sump to a lower pressure oil pump side via a bypass line. Further, at a second condition, engine oil downstream of the reciprocating engine components may be routed to the oil sump, for example in a path separate from the bypass line.

In this way, it is possible to provide the available engine heat and friction heat from the engine components to a smaller volume of oil, where that smaller volume of oil is preferentially used as compared to colder oil in the sump. As such, the oil actually provided to the engine components heats up more rapidly for a given amount of heat input, whether from friction, waste heat recovery, electric heater, and the like, which may be used, if desired. Then, once sufficient warm-up has occurred where substantially all of the engine oil, including oil in the sump, has reached a desired operating temperature, the bypass oil line may be disabled. As such, during over-temperature conditions, the full oil supply is available to reduce oil over-heating.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

An internal combustion engine may be used as a drive for motor vehicles. Within the context of the present disclosure, "internal combustion engine" encompasses diesel engines, spark-ignition engines, and hybrid internal combustion engines (e.g., an internal combustion engine operated with a hybrid combustion process). In some embodiments, the engine may be coupled to an electric motor/battery system in a hybrid vehicle. Non-limiting examples of hybrid vehicles may have a parallel configuration, a series configuration, or any suitable variation or combination thereof.

Figure 1:
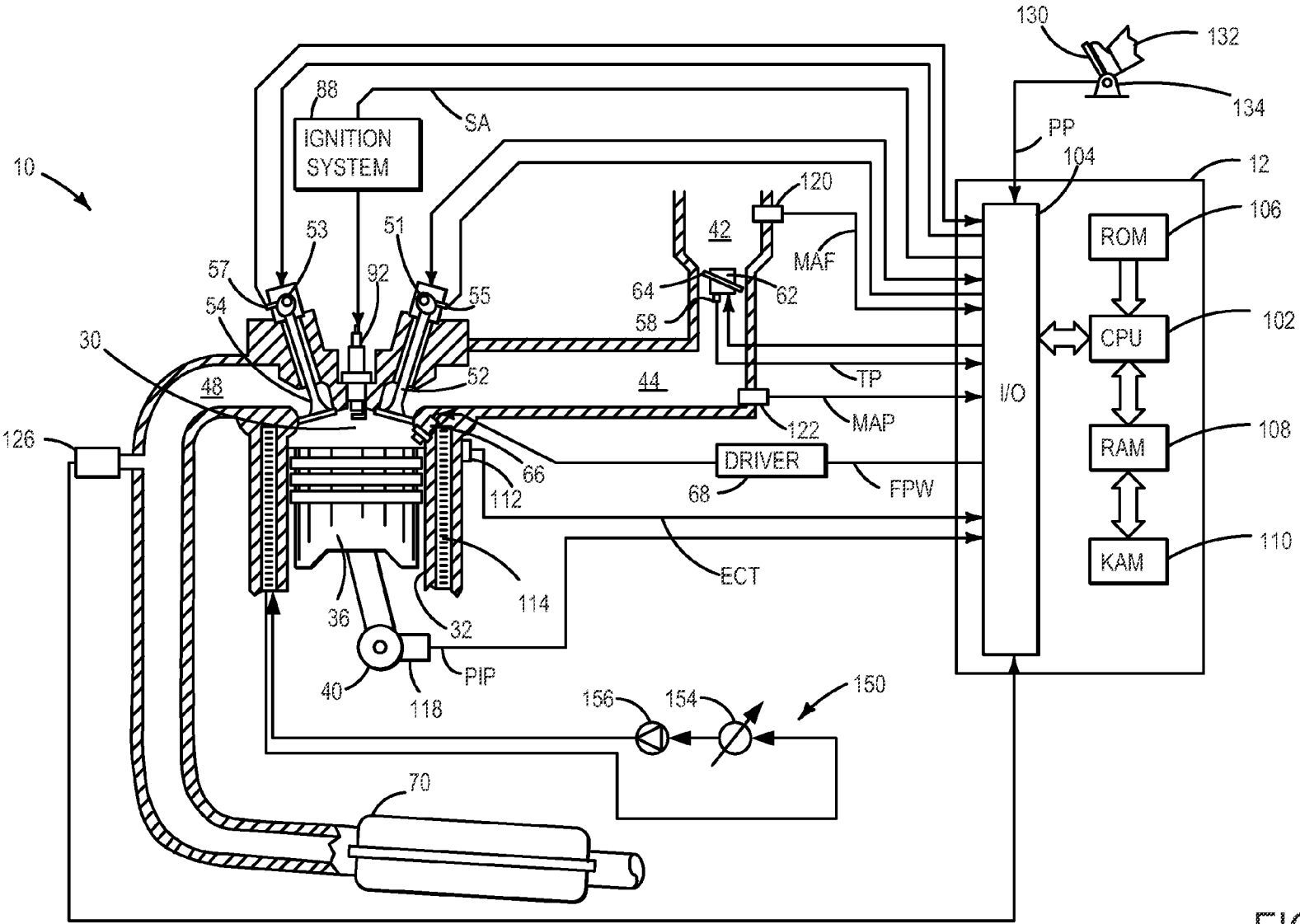
FIG. 1 schematically shows an embodiment of an engine according to the present disclosure.

Internal combustion engines have a cylinder block and a cylinder head that are united to form a cylinder for combusting fuel. Referring to FIG. 1, internal combustion engine 10 comprises a plurality of cylinders, one cylinder of which is shown in FIG. 1. Engine 10 includes combustion chamber 30 and cylinder walls 32 with piston 36 positioned therein and connected to crankshaft 40. Engine 10 is controlled by electronic engine controller 12.

During operation of engine 10, combustion chamber 30 is charged with air and fuel, burns the fuel, and discharges exhaust gas. Valves are generally used to control the charge exchange. Typically, such valves are movable along their longitudinal axis between a closed position and an open position to open and shut an inlet or outlet opening. In one non-limiting example, valves include valve springs that are preloaded in the direction of the closed position and valve actuating devices, or cams, which open the valves against the preload of the valve springs. The valve actuating devices generally comprise one or more camshafts on which a plurality of cams is arranged. The camshafts are rotated by a drive from crankshaft 40. In one non-limiting example, a camshaft may be rotated by a chain drive.

In some embodiments, overhead camshafts may be included in engine 10. Overhead camshafts are mounted in the cylinder head and are arranged above the assembly surface between the cylinder head and cylinder block. Overhead camshafts are often mounted in two-part camshaft receptacles. For this purpose, the overhead camshaft has at least two bearing points, which are generally formed as thickened shaft shoulders.

As shown in FIG. 1, combustion chamber 30 communicates with intake manifold 44 and exhaust manifold 48 via respective intake valve 52 and exhaust valve 54. Each intake and exhaust valve may be operated by an intake cam 51 and an exhaust cam 53, each cam being mounted on an associated camshaft. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Generally, an upper crankcase is formed by the cylinder block, and is complemented by a lower crankcase, which may be mounted on the upper crankcase by screws, bolts, or other suitable connectors. The lower crankcase may include an oil collection sump, such as an oil pan. In some embodiments, the upper crankcase may include a flange surface to hold the oil sump and a seal to seal off the oil sump or the crankcase with respect to the environment.

The oil sump collects and stores the engine oil and is part of the lubricating system. Furthermore, the oil sump may act as a heat exchanger, reducing the oil temperature when the internal combustion engine is at operating temperature. For example, the oil in the oil sump may be cooled by conduction and/or by convection of heat to a heat sink and/or to air conducted over the outside of the oil sump.

Fuel injector 66 is shown positioned to inject fuel directly into combustion chamber 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 that responds to controller 12. In addition, intake manifold 44 is shown communicating with optional electronic throttle 62. Electronic throttle 62 adjusts a position of throttle plate 64 to control airflow from air intake 42 to intake manifold 44. In one example, a low-pressure direct injection system may be used, where fuel pressure can be raised to approximately 20-30 bar. Alternatively, a high pressure, dual stage, fuel system may be used to generate higher fuel pressures.

Distributorless ignition system 88 provides an ignition spark to combustion chamber 30 via spark plug 92 in response to controller 12.

The heat released into the cylinder head during the combustion is dissipated partially to the cylinder head and the cylinder block and partially to the adjacent components and the environment via the exhaust gases. Cooling system 150 is included to manage heat loads within engine 10. The cylinder head may be equipped with a coolant jacket or cooling sleeve 114, which may be at least partially integrated in the cylinder head via coolant ducts. In some embodiments, cooling system 150 may be a water cooling system. For example, in the embodiment shown in FIG. 1, a liquid coolant is pumped by coolant pump 156 between cooling sleeve 114 and heat exchanger 154. In some embodiments, heat exchanger 154 may be an air-cooled radiator.

Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126. Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor 102, input/output ports 104, read-only memory 106, random access memory 108, keep alive memory 110, and a conventional data bus.

Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure, engine oil temperature, engine oil pressure, etc. may also be sensed (sensors not shown) for processing by controller 12.

In one embodiment, engine position sensor 118 produces a predetermined number of equally spaced pulses every revolution of the crankshaft from which engine speed (RPM) can be determined.

In one embodiment, the stop/start crank position sensor has both zero speed and bi-directional capability. In some applications, a bi-directional Hall sensor may be used. In other applications, magnets may be mounted to the target. Magnets may be placed on the target and the "missing tooth gap" can potentially be eliminated if the sensor is capable of detecting a change in signal amplitude (e.g., using a stronger or weaker magnet to locate a specific position on the wheel). Further, by using a bi-directional Hall sensor or an equivalent, the engine position may be maintained through shut-down, but an alternative strategy may be used during re-start to assure that the engine is rotating in a forward direction.

During operation, each cylinder within engine 10 typically undergoes a four-stroke cycle. The cycle includes an intake stroke, a compression stroke, an expansion stroke, and an exhaust stroke. Generally, exhaust valve 54 closes and intake valve 52 opens during the intake stroke. Air is introduced into combustion chamber 30 via intake manifold 44, and piston 36 moves to the bottom of the cylinder to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). Fuel is introduced into combustion chamber 30 in a process hereinafter referred to as injection. In a process hereinafter referred to as ignition, the injected fuel is ignited by a suitable ignition source, such as spark plug 92, resulting in combustion.

During the expansion stroke, the expanding combustion gases push piston 36 back to BDC. Piston 36 transmits the forces generated by the expanding gases to crankshaft 40. For this purpose, piston 36 is articulately connected to a connecting rod by a piston pin, the connecting rod being movably mounted on crankshaft 40. Crankshaft 40 (which is mounted in a crankcase) absorbs the connecting rod forces, including the forces resulting from combustion and the mass forces resulting from non-uniform movement of the engine parts. The oscillating stroke movement of piston 36 is transformed into a rotational movement of crankshaft 40. Thus, crankshaft 40 converts linear piston movement into a rotational torque.

Finally, during the exhaust stroke, exhaust valve 54 opens to release the combusted air-fuel mixture into exhaust manifold 48 and piston 36 returns to TDC. Note that the above is provide merely as an example, and that intake and exhaust valve opening and/or closing timings may vary, such as to provide positive or negative valve overlap, late intake valve closing, or various other attributes associated with the operation of engine 10.

Crankshaft 40 transmits the rotational torque to the drivetrain. In some embodiments, a portion of the energy transmitted to crankshaft 40 also drives auxiliary units (e.g., oil pumps, alternators, etc.) and/or drives a camshaft to actuate a valve drive. In some embodiments, the camshaft may be mounted in the cylinder head as an overhead camshaft.

Crankshaft 40 is mounted with one or more crankshaft journals. The crankshaft journals may be spaced apart from one another along a crankshaft axis. In some embodiments, the crankshaft journals may be formed as thickened shaft shoulders. To hold and mount crankshaft 40, at least two bearings are provided in the crankcase. In some embodiments, such bearings may be of a two-part design, comprising a bearing saddle and a bearing cover connected to the bearing saddle. In one example, bearing covers and bearing saddles may be formed as separate components. In another example, the bearing covers and bearing saddles may be integrated into upper and a lower crankcase portions that are later joined to form the crankcase. Complementary pairs of bearing saddles and bearing covers are assembled to form bores for holding the crankshaft journals. In some embodiments, bearing shells may be arranged as intermediate elements between the crankshaft and the bearings. Similar to a plain bearing, the bores are supplied with engine oil to form a load-bearing lubricating film between an inner surface of each bore and the associated crankshaft journal.

Figure 2:
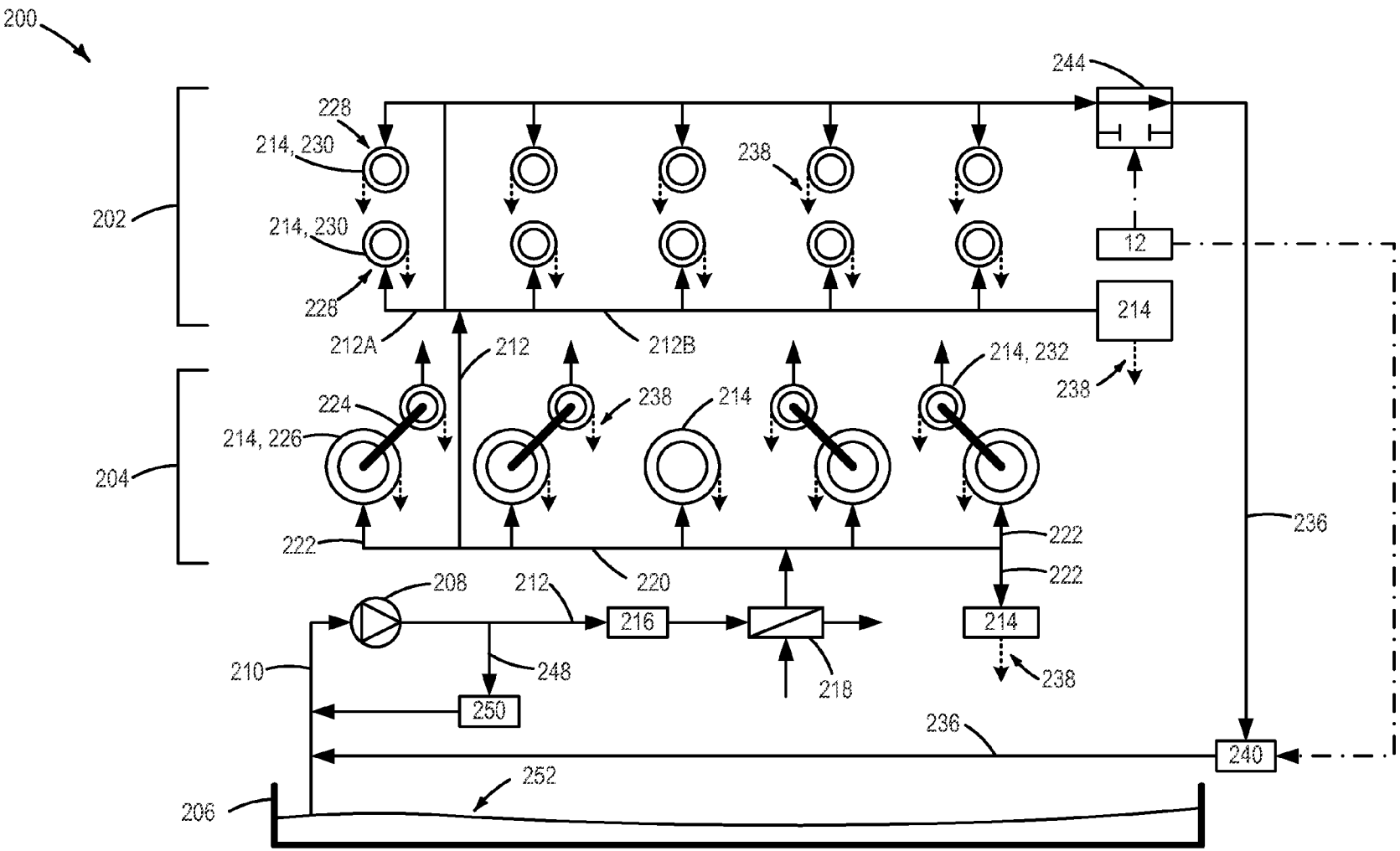
FIG. 2 schematically shows an embodiment of an engine oil delivery system according to the present disclosure.

FIG. 2 schematically shows an embodiment of an oil delivery system 200 for engine 10. As depicted in FIG. 2, oil delivery system 200 provides engine oil to various consumers 214. As used herein, "consumer" means a portion of the engine that uses engine oil, or enjoys one or more properties provided by the engine oil, as a part of fulfilling and maintaining the function of consumer 214 within engine 10. Examples of consumers 214 include, but are not limited to, crankshaft 40, camshafts, connecting rods, balancing shafts, and the various bearings and receptacles associated therewith. Accordingly, it will be appreciated that any suitable portion of engine 10 having an application for a lubricating film may be a consumer 214. However, it will also be appreciated that, as used herein, "consumer" does not necessarily imply that the engine oil is actually spent, depleted, or exhausted by consumer 214. For example, a "consumer" may be a spray oil cooling arrangement that wets an underside of a piston crown with nozzles at the crankcase side. The piston crown forms a part of the combustion chamber inner wall and, together with the piston rings, seals off combustion chamber 30 with respect to the cylinder block or the crankcase, such that no combustion gases pass into the crankcase and no oil passes into combustion chamber 30. Thus, engine oil is not burned within combustion chamber 30, but may return to oil sump 206 for reuse. Other examples of consumers are described in more detail below.

To supply consumers 214 with oil, oil pump 208 feeds engine oil to the bearings via one or more delivery conduits or supply lines 212 and a main oil gallery 220, from which ducts 222 lead to consumers 214. Downstream of consumers 214, return lines 238 conduct the engine oil to oil sump 206 for reuse. As shown in FIG. 2, oil sump 206 includes a stored engine oil supply 252 for use in oil delivery system 200. Typically, the return of the engine oil to oil sump 206 is gravity-driven. Thus, in some embodiments, oil delivery system 200 may be divided into a high-pressure part and a low-pressure part, with the high-pressure part comprising portions of oil delivery system 200 upstream of consumers 214 and the low-pressure part comprising portions of oil delivery system 200 downstream of consumers 214.

Oil pump 208 is supplied with engine oil from oil sump 206 via a suction line 210. Oil pump 208 draws engine oil through suction line 210 at a lower pressure, expelling engine oil via supply line 212 at a higher pressure. In some embodiments, oil pump 208 may be sized to provide an application-specific engine oil volume and/or engine oil pressure in supply line 212.

As depicted in the embodiment shown in FIG. 2, supply line 212 includes an oil filter 216. Oil filter 216 is provided in supply line 212 downstream of oil pump 208 and upstream of the first consumer 214 in oil delivery system 200. Oil filter 216 traps some particles present in the engine oil. For example, some particles may originate from the abrasion of moving parts within engine 10. Oil filter 216 traps a portion of such particles, which might pose a risk to the functional capability of consumers 214 and assemblies arranged in oil delivery system 200.

As shown in FIG. 2, supply line 212 also includes an oil cooler 218, which will be described in more detail below. Oil filter 216 and oil cooler 218 are not included among consumers 214.

Typically, supply line 212 leads from oil pump 208 through the cylinder block to main oil gallery 220. In some embodiments, main oil gallery 220 is formed at least in part by a main supply duct aligned along a longitudinal axis of crankshaft 40. The main supply duct may be arranged above or below crankshaft 40 in the crankcase or may be integrated into crankshaft 40.

As depicted in FIG. 2, oil delivery system 200 includes a cylinder head side 202 and a cylinder block side 204, so that engine oil passes through the head and through the block of engine 10. As used herein, all sections of oil delivery system 200 which lie on the side of the assembly surface facing away from the cylinder block are considered to belong to the cylinder head side 202, with the assembly surface being the surface at which the cylinder block and the cylinder head are connected to one another. Typically, the cylinder head experiences a higher heat load than the cylinder block, such that more heat may be transferred to the engine oil flowing through the cylinder head than to the engine oil flowing through the cylinder block.

In some embodiments, supply line 212 leads engine oil first through the cylinder block before supply line 212 enters the cylinder head. In such embodiments, the engine oil is heated as it passes through the cylinder block, so that cylinder head side 202 of the oil circuit is supplied with engine oil that has been heated in the cylinder block. Engine oil is further heated in cylinder head side 202 of oil delivery system 200. For example, after a period of standstill of the vehicle, such as during a restart of internal combustion engine 10, engine oil flows through the cylinder block, where it is heated. The heated oil is subsequently heated further in the cylinder head, which reaches high temperatures more quickly because of the combustion processes. Thus, the heating of engine oil may be more pronounced than it would be if engine oil were to flow through the cylinder block alone.

Alternatively, in some embodiments, supply line 212 of oil delivery system 200 may pass first through the cylinder head before supply line 212 enters the cylinder block. For example, in the case of low outside temperatures, heating of the oil may be assisted by a faster heating cylinder head. This effect may be more pronounced if additional optional features are included in engine 10. For example, the integration of exhaust manifold 48 into the cylinder head may assist engine oil heating in the cylinder head, as explained in more detail below.

In some embodiments, supply line 212 comprises at least two partial supply lines extending through the cylinder head. This may increase the surface area available for heat exchange with the engine oil within the cylinder head. Partial supply lines may subsequently merge to reform supply line 212 within or downstream of the cylinder head.

For example, in the embodiment shown in FIG. 2, supply line 212 forks into partial supply lines 212A and 212B. In some embodiments, supply line 212 and the partial supply lines within the cylinder head may be configured according to predetermined heat exchange parameters. For example, in one scenario the arrangement of supply line 212 and the partial supply lines within the cylinder head may be configured to optimize heat transfer to the engine oil. In some embodiments, supply line 212 may split into two or more partial supply lines within or upstream of the cylinder head. Further, in some embodiments, portions of the partial supply lines may run parallel to one another.

In some embodiments, engine 10 may include at least two cylinders, each having at least one exhaust port joined to an exhaust line, with the exhaust lines of at least two cylinders merging to form exhaust manifold 48. In some embodiments, the exhaust gases may be supplied to a turbocharger and/or to one or more exhaust-gas after-treatment systems downstream of exhaust manifold 48.

For example, one or more turbochargers may be located close to exhaust manifold 48. Locating the turbocharger close to exhaust manifold 48 may provide a faster response at the turbocharger compared to a more distant location because the enthalpy of the exhaust gas is a function of pressure and temperature, which typically diminish as distance from exhaust manifold 48 increases. In another example, exhaust gas treatment systems may be located close to exhaust manifold 48 so that the exhaust-gas treatment systems, supplied with heat from the exhaust gases, may reach operating, activation, or light-off temperatures faster compared to more distant locations. Thus, it will be appreciated that one approach to achieving faster response and activation times from turbochargers and treatment systems may be directed at reducing the mass and the length of the exhaust line, which may reduce a thermal inertia of the exhaust line.

For example, in some embodiments, the exhaust lines may be merged within the cylinder head to form an integrated exhaust manifold. Integrated exhaust manifolds may provide comparatively more compact packaging of the exhaust lines relative to an external exhaust manifold system. In one scenario with a cylinder head having four cylinders in an in-line arrangement, the exhaust lines of the outer cylinders and the exhaust lines of the inner cylinders may merge into one exhaust line. It will be appreciated that a similar approach may be employed, for example, with cylinder heads having three or more cylinders, in which the exhaust lines of two of the three cylinders merge to form an overall exhaust line.

Cylinder heads having an integrated exhaust manifold typically experience higher heat loads than cylinder heads with external exhaust manifolds. Thus, in some embodiments, heating engine oil in a cylinder head that includes an integrated exhaust manifold may contribute to a further reduction in the friction losses of engine 10. For example, during a warm-up condition after a cold start of engine 10, a cylinder head with an integrated exhaust manifold may reach higher temperatures more quickly compared to a cylinder head with an external manifold. Thus, engine oil conducted through the cylinder head having an integrated exhaust manifold may be heated relatively more quickly.

Because a cylinder head with an integrated exhaust manifold may experience a higher heat load than a cylinder head with an external manifold, cooling system 150 may assist in controlling and/or limiting an upward temperature rise of the engine oil in some conditions.

In other conditions, engine 10 may heat the coolant in cooling system 150 faster than the engine oil is heated. Under such conditions, cooling system 150 may be configured to transfer heat to the engine oil. For example, during a warm-up condition, heat from the coolant may be used to heat the engine oil at a heat exchanger, such as oil cooler 218. Thus, it will be appreciated that the heat transfer between the cylinder head and the engine oil situated in the supply line may comprise the introduction of heat into, or extraction of heat from, the engine oil by cooling system 150 in addition to the introduction of heat from hot exhaust gases.

In some embodiments, cooling sleeve 114 may extend at least partially between the at least two partial supply lines. For example, cooling sleeve 114 may be configured to intersect an imaginary boundary encompassing the at least two partial supply lines. As such, the coolant within cooling sleeve 114 may assist in managing heat transfer to the engine oil. This may offset overheating and/or aging of the engine oil. Further, such approaches may mitigate coking processes in the engine oil, potentially reducing the formation of deposits and/or blockages in supply line 212, the partial supply lines, etc.

Having been heated, engine oil is supplied to consumers 214 via supply line 212. Consumers 214 in the cylinder block include bearings for connecting rods 224, including crankshaft-side connecting rod bearings 226 and piston-side connecting rod bearings 232 and one or more crankshaft bearings. In some embodiments, engine oil may be conducted downstream of oil pump 208 first to main oil gallery 220 to supply engine oil to crankshaft bearings before engine oil flows to the cylinder head.

Consumers 214 in the cylinder head comprise camshaft bearings 230 included within camshaft receptacles 228, though it will be appreciated that other suitable consumers 214 may be included in some embodiments. Camshaft bearings 230 are supplied with engine oil such that a load-bearing lubricating film is formed as the camshaft rotates. Supplying heated engine oil to the camshaft bearings 230 via supply line 212 may reduce the friction in the bearings of the camshaft and consequently may reduce friction losses in engine 10.

The camshaft may be mounted similarly to the above-described crankshaft mounting approach. For example, in some embodiments employing overhead camshafts, camshaft receptacles 228 may have a two-part construction. A two-part camshaft receptacle comprises a lower part and an upper part in which the bearing saddles and bearing covers are arranged. The overhead camshaft is held and mounted with its bearing points in the bearing saddles and bearing covers. In such embodiments, supply line 212 is connected to the two-part camshaft receptacle.

Accordingly, camshaft receptacle 228 is supplied with engine oil via supply line 212, which branches from main oil gallery 220, extends through the cylinder block, and, in some embodiments including overhead camshafts, extends into the cylinder head. Additionally or alternatively, in some embodiments, supply line 212 may lead from the pump directly into the cylinder head, supplying engine oil to camshaft receptacle 228 upstream of main oil gallery 220. It will be appreciated that these approaches apply to both an inlet-side camshaft and to an outlet-side camshaft.

In some embodiments, consumers 214 may also include various valve drive components, such as a hydraulically-actuated camshaft adjuster.

In some embodiments, consumers 214 may be supplied with engine oil on a regular, but not a continuous, basis. For example, if a bearing engine oil supply interacts with a different engine oil supply (for example, via main oil gallery 220), continuously supplying oil to the bearings may disturb the engine oil pressure in oil delivery system 200. Thus, a regular, but not continuous, oil supply to the bearings may be employed in such embodiments.

After the engine oil is supplied to consumers 214, engine oil returns to oil sump 206 via return lines 238 passing through the cylinder head and/or through the cylinder block. Generally, engine oil in a return line 238 is at a lower pressure than engine oil upstream of return line 238. In some embodiments, flow of engine oil through return lines 238 is gravity-driven.

As shown in FIG. 2, bypass line 236 has an inlet coupled to engine 10 at cylinder head side 202, so that bypass line 236 may divert a portion of engine oil from the portion of the oil circuit integrated within the cylinder head. The outlet of bypass line 236 is coupled to the low pressure side of oil pump 208.

Because the engine oil diverted through bypass line 236 avoids the cooling effect at oil sump 206, the engine oil may have a higher temperature than that of engine oil supply 252. Accordingly, reintroducing the heated engine oil to the inlet of oil pump 208 may increase the engine oil throughput in oil delivery system 200 after a cold start. With the increased throughput, the flow rate of the engine oil may also increase, potentially increasing convective heat transfer to the engine oil from engine 10, particularly from the cylinder head and the cylinder block. Generally, the faster the engine oil is heated, the faster the viscosity of the oil decreases, and the faster the friction losses are reduced. Further, the energy consumption of oil pump 208 may be reduced when bypass line 236 is open, which may reduce fuel consumption and improve the efficiency of engine 10. Accordingly, by programmatically controlling the diversion of oil through bypass line 236, it may be possible to adjust the fuel consumption and the emissions of engine 10.

While the embodiment shown in FIG. 2 depicts bypass line 236 having an inlet that is upstream of camshaft receptacle 228 and camshaft bearing 230, it will be appreciated bypass line 236 may have an inlet at any suitable location within oil delivery system 200. In some embodiments, bypass line 236 may have an inlet at any suitable location in cylinder head side 202.

In some previous examples, oil sump bypasses have been configured to divert oil directly downstream of the pump. However, the provision of bypass line 236 in the cylinder head may provide more heat to engine oil relative to a branch directly downstream of the pump, and may therefore heat the engine oil comparatively more quickly.

For example, after a cold start of engine 10, the cylinder head heats up comparatively quickly relative to the cylinder block due in part to the combustion processes. A portion of the engine oil heated in the cylinder head is recycled via bypass line 236 to the inlet of oil pump 208, bypassing oil sump 206. The heated engine oil may then be recirculated via supply line 212 to various consumers 214. Thus a quicker warm-up of engine 10 may be achieved relative to examples where oil is diverted upstream of the cylinder head and the cylinder block. Further, the comparatively fast heating of the engine oil during the warm-up phase of engine 10 may provide a correspondingly speedy decrease in engine oil viscosity, which may provide a reduction in friction losses at consumers 214. While FIG. 2 depicts bypass line 236 as branching from the oil circuit at cylinder head side 202, it will be appreciated that, in some embodiments, bypass line 236 may branch from the oil circuit at cylinder block side 204.

In some embodiments, bypass line 236 may include a bypass valve 244. Bypass valve 244 may be controlled remotely, such as via engine controller 12 as shown in the embodiment depicted in FIG. 2. Alternatively, in some embodiments, bypass valve 244 may be controlled by an onboard bypass valve controller. Bypass valve 244 may be actuated by any suitable approach in response to a control signal. Non-limiting actuation examples include electric, hydraulic, pneumatic, mechanical, or magnetic actuation.

Oil may be diverted to bypass line 236 according to an engine condition of engine 10. The engine conditions for which engine oil is diverted via bypass line 236, and at which bypass valve 244 is open, may be stored in instructions, which may include a condition map or lookup table, loaded into memory and executed by microprocessor 102 of engine controller 12. It will be appreciated that the engine conditions may include conditions such as speed, load, combustion, and temperature conditions of engine 10, as well as other conditions, such as warm-up, steady-state, and cool-down conditions. Non-limiting example engine conditions are described in more detail below.

In one scenario, the condition map may specify that, at some engine conditions, such as low engine speed, low load and/or low temperature conditions, bypass valve 244 is open. Low temperature conditions may include, but are not limited to, low engine temperature conditions such as engine oil temperature conditions below a first threshold and engine coolant temperature conditions below a second threshold. At other engine conditions, such as high engine speed, high load, and/or high temperature conditions (e.g., speeds, loads, and/or temperatures above respective thresholds), the condition map may indicate that bypass valve 244 is closed. High temperature conditions may include, but are not limited to, high engine temperature conditions such as high engine oil temperature conditions and high engine coolant temperature conditions.

In another scenario, the condition map may specify that during an engine warm-up condition, bypass valve 244 is open. At the end of the engine warm-up condition, the condition map may specify that bypass valve 244 is closed.

In yet another scenario, the condition map may specify that bypass valve 244 is controlled according to an engine oil temperature condition, such as a predetermined engine oil temperature threshold. Thus, the condition map may direct that bypass valve 244 is open below the predetermined engine oil temperature threshold and is closed when the engine oil temperature exceeds the predetermined engine oil temperature threshold.

In some embodiments, bypass line 236 may include a pressure control valve 240. For example, pressure control valve 240 may include a hydraulically controlled or actuated valve that opens if a predetermined oil pressure threshold is exceeded. In such embodiments, pressure control valve 240 operates in response to oil pressure in bypass line 236. Thus, in an embodiment including bypass valve 244, pressure control valve 240 may act automatically in response to oil pressure changes induced by contemporaneous actions at bypass valve 244. In one non-limiting example, pressure control valve 240 may include check valve, such as a 2/2 directional valve having two ports and two switching positions.

In embodiments that omit bypass valve 244, pressure control valve 240 controls the flow of oil through bypass line 236. In such embodiments, pressure control valve 240 may be electrically controlled by engine controller 12 or by other suitable hydraulic, pneumatic, mechanical, or magnetic controllers. In such embodiments, the condition map may include predefined engine oil pressure thresholds for opening pressure control valve 240 at different engine conditions, such that pressure control valve 240 opens or closes at different engine oil pressures under different engine conditions. Alternatively, in some examples, pressure control valve 240 may be controlled according to a predefined engine oil pressure threshold that is independent of the engine conditions.

Further, in some embodiments that omit bypass valve 244, pressure control valve 240, controlled by engine controller 12, may open at a predefined bypass set point ($p_{threshold,bypass}$) that is lower than a predefined overpressure set point ($p_{threshold,short}$) for opening an overpressure valve in a recycle loop, described in more detail below. In one scenario, $p_{threshold,bypass}$ may be set at 2 bar and $p_{threshold,short}$ may be set at 4 bar. However, it will be appreciated that any suitable set points may be employed within the scope of the present disclosure.

In some embodiments, bypass line 236 may also act as a recycle loop. In one example where bypass valve 244 is omitted, pressure control valve 240 may be configured or controlled to limit the oil pressure in the oil circuit, such that pressure control valve 240 opens automatically if a predefined oil pressure is exceeded. However, because bypass line 236 may be distant from the outlet of oil pump 208, it may be difficult to estimate head loss and pressure drop of those portions of the oil circuit that are intermediate to oil pump 208 and bypass line 236.

Thus, in some embodiments, oil delivery system 200 may include a recycle loop 248. Where provided, recycle loop 248 may adjust engine oil pressure within oil delivery system 200. For example, when bypass line 236 is closed, recycle loop 248 may divert a portion of the engine oil from the outlet of oil pump 208 to the inlet of oil pump 208. In one example, recycle loop 248 may branch from supply line 212 directly downstream of oil pump 208. Because this location is close to the outlet of oil pump 208, the effects of various pressure drops within oil delivery system 200 may be smaller than for a more distant location. For example, pressure drop across oil filter 216 may vary as a function of oil temperature. By locating the branch point for recycle loop 248 upstream of oil filter 216, such pressure drop variation may not affect the operation of recycle loop 248. Thus, it will be appreciated that, in some embodiments, oil filter 216, oil cooler 218, etc., may be located downstream in supply line 212 from an inlet of recycle loop 248.

In some embodiments, an overpressure valve 250 may be included within recycle loop 248. Overpressure valve 250 may open automatically if a predefined engine oil pressure threshold is exceeded. For example, overpressure valve 250 may automatically open at relatively high pressures, such as those that might be realized when bypass line 236 is closed after the warm-up phase has ended. In one scenario, of a predefined engine oil pressure threshold for opening overpressure valve 250 may be 4 bar. In some embodiments, overpressure valve 250 may be an automatically opening check valve such as a 2/2 directional valve with two feed lines or ports and two switching positions (e.g., open or closed).

It will be appreciated that extended storage at high temperatures may degrade engine oil lifetime. Thus, storing engine oil in an insulated reservoir may reduce the working life of engine oil. Accordingly, heated engine oil may be cooled in various components of oil delivery system 200. As described previously, the oil may be cooled in oil sump 206 by means of air cooling.

In some embodiments, oil sump 206 may include cooling fins, thereby increasing the surface area available for heat dissipation. The heat dissipation may occur via convective heat transfer to an air flow conducted past oil sump 206. In some examples, the air flow may be provided when the vehicle is in motion. Optionally, a fan may be included to supplement the air flow while the vehicle is in motion and/or to provide air flow when the vehicle is not in motion. Oil sump 206 may include materials selected in consideration of heat dissipation characteristics.

In some embodiments, oil cooler 218 may be included in supply line 212. For example, oil cooler 218 may be included downstream of oil pump 208 and upstream of the first consumer 214 in the oil circuit. In some embodiments, oil cooler 218 may comprise a liquid coolant oil cooler that extracts heat from the engine oil using the coolant of the cooling system 150. In some engine conditions, such as during a steady-state operating condition, coolant supplied to oil cooler 218 may reduce the temperature of the oil flowing through oil cooler 218, and may keep the engine oil temperature within a predetermined oil temperature range. In some other engine conditions, such as during cold start conditions, coolant heated by engine 10 may be supplied to oil cooler 218 to increase the temperature of the engine oil flowing through oil cooler 218.

In some embodiments, oil cooler 218 may be activated on demand. While the above-described oil cooler 218 relates to a liquid-cooled oil cooler, it will be appreciated that, in some embodiments, oil cooler 218 may comprise an air-operated oil cooler.

Figure 3:
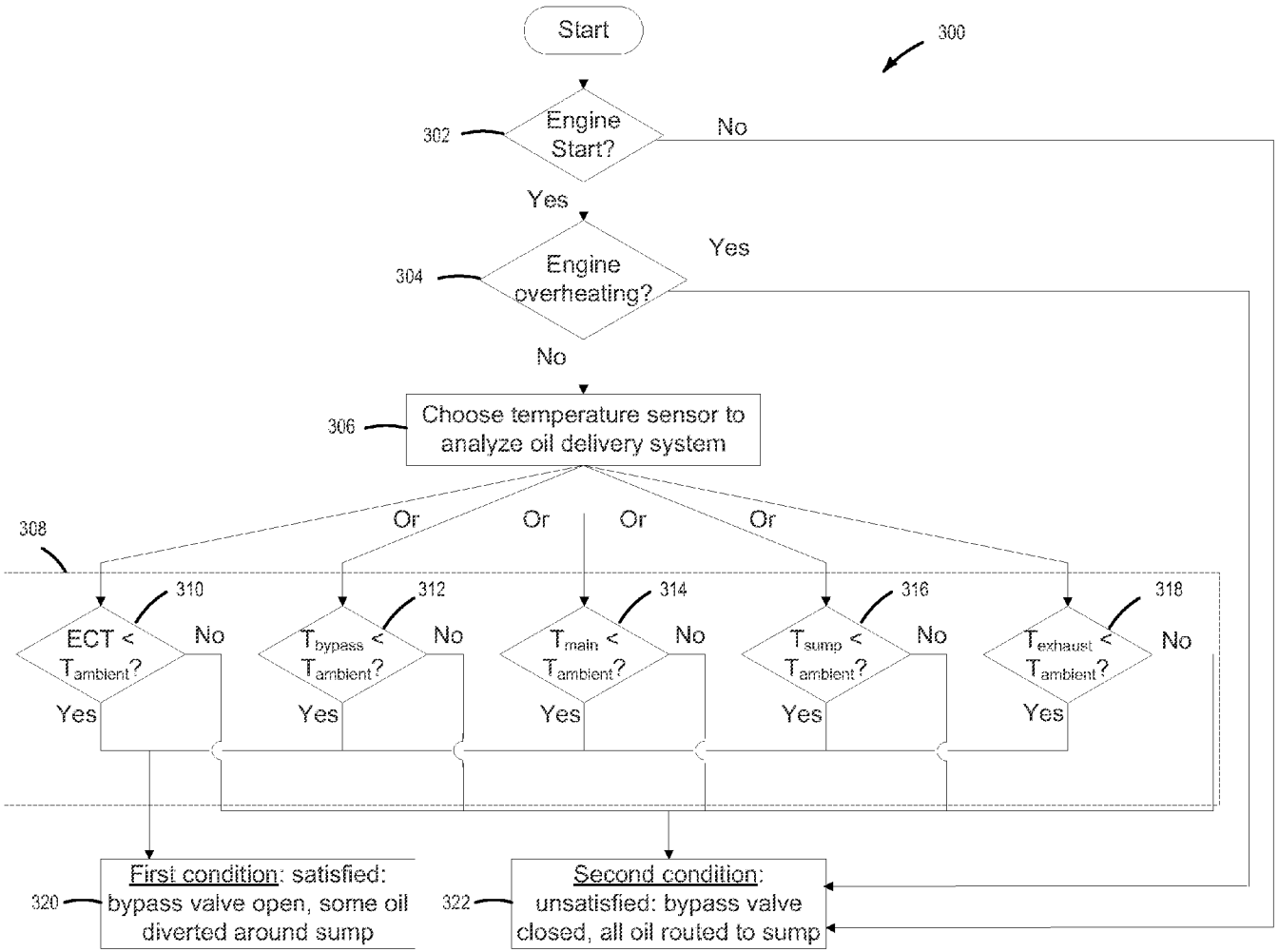
FIG. 3 shows a flow chart for an embodiment of a method for heating of engine oil during a cold start according to the present disclosure.

FIG. 3 shows an example method 300 for controlling operation of the oil delivery system. In one example, the method of FIG. 3 operates to control heating of engine oil during a cold start to more quickly heat engine oil and thus reduce engine oil viscosity. In this way, it is possible to address higher viscosity conditions, such as low ambient and/or engine temperature conditions.

FIG. 3 shows an example flowchart for an embodiment of method 300 for operating the bypass line in an oil delivery system during a cold start and determining which operating condition to pursue, first condition 320 or second condition 322. In the present embodiment, first condition 320 is satisfied by a lower temperature and second condition 322 is satisfied by a higher temperature. In some embodiments, determining whether the bypass line operating condition is satisfied may be performed by a controller, such as controller 12. For example, the controller may compare one or more temperature sensor signals or operating state conditions with preselected threshold temperatures and operating states stored in a look up table when judging the satisfaction of the bypass line operating condition. Additionally or alternatively, in some embodiments, determining whether the bypass line operating condition is satisfied may be performed by mechanical thermostats and/or relays triggered and/or latched responsive to bypass line operating parameters.

While the scenarios described below make reference to the bypass line operating parameters and hardware described above, it will be appreciated that method 300 may be used with other suitable bypass line operating parameters and/or hardware, and is not limited to the descriptions set forth.

With reference to FIG. 3, at 302 the routine determines whether the engine is in the process of being started, or whether the time since the engine start is less than a threshold amount. In one example, the routine may determine whether the start is a cold start, indicating that the engine is being started from a condition where the engine had cooled to ambient temperature conditions. When the answer to 302 is NO, the controller instructs the oil delivery system to operate in second condition 322, where the bypass valve is closed and all of the oil is routed to the oil sump. Likewise, if the engine starts but is overheating, e.g., a hot engine restart under some degraded conditions, the controller instructs the oil delivery system to operate in second condition 322.

At 306, the routine selects one or more temperatures to utilize in determining whether to operate the oil bypass. For example, under some conditions, oil temperature may dictate whether to bypass oil, or not to bypass oil. In other conditions, coolant temperature may dictate whether to bypass oil, or not to bypass oil. Further, in still other example, a combination of various temperatures may determine whether to bypass oil or not around the sump.

In another example, the controller may utilize the speed of the engine or the load of the engine as an operating parameter to determine the oil delivery system operating state. In the present example, the controller holds instructions to execute an operating condition based on one or more of the engine coolant temperature ECT 310, or the temperature of the bypass line $T_{bypass}$ 312, or the temperature of the main line $T_{main}$ 314, or the temperature of the sump $T_{sump}$ 316, or the temperature of the exhaust $T_{exhaust}$ 318. There may be additional temperature sensors that the controller may utilize to determine the operating condition of the oil delivery system. When the ECT is less than the ambient temperature $T_{ambient}$, or $T_{bypass}$ is less than $T_{ambient}$, or $T_{main}$ is less than $T_{ambient}$ or $T_{sump}$ is less than $T_{ambient}$ or $T_{exhaust}$ is less than $T_{ambient}$, the oil delivery system is set to first condition 320, which corresponds to opening the bypass valve, allowing a portion of the oil from the reciprocating engine components to be diverted around the oil sump to a lower pressure side of the oil pump while concurrently circulating oil from the reciprocating engine components via the oil sump to the lower pressure side of the oil pump. This may provide a faster heat up for the engine oil in a cold start scenario, potentially reducing engine frictional losses and/or emissions faster than if all of the engine oil were to be circulated through the oil sump.

When the ECT is not less than $T_{ambient}$, or $T_{bypass}$ is not less than $T_{ambient}$, or $T_{main}$ is not less than $T_{ambient}$ or $T_{sump}$ is not less than $T_{ambient}$, or $T_{exhaust}$ is not less than $T_{ambient}$, the oil delivery system is set to second condition 322, the bypass valve is closed and all the oil from the reciprocating engine components is routed to the lower pressure side of the oil pump via the oil sump.

It will be appreciated that the controller holds instructions for method 300, stored in memory and executed on a processor to perform the embodiment described above for method 300. It will also be appreciated that while method 300 illustrates a finite pathway for the controller to analyze the oil delivery system, other embodiments may comprise more than one loop of method 300 involving the controller to reevaluate a bypass line operating parameter 308 to determine the oil delivery system operating condition; a first condition 320 or a second condition 322. The reevaluation may incorporate different sensors or different combinations of sensors, such as engine speed sensors and/or load sensors with each evaluation, examples of which are discussed further below. In some embodiments, the controller may also comprise continual monitoring of the oil delivery system. Additionally or alternatively, method 300 may monitor the bypass line operating condition periodically and/or responsive to a trigger event. For example, in one scenario, method 300 may monitor the bypass line operating condition only on engine start.

In some embodiments, method 300 may include, heating the engine oil with heat from an engine coolant. For example, in a scenario where an engine coolant temperature exceeds an engine oil temperature, warmer engine coolant flowing through an oil cooler may transfer heat to the engine oil.

While method 300 is discussed above with respect to a cold start scenario, it will be appreciated that method 300 may used to operate the bypass line in any suitable situation.

For example, in one scenario, method 300 may operate the bypass line responsive to an engine speed parameter. Because low engine speeds may have lower engine operating temperatures, engine speed may be a proxy for engine temperature, such as when an engine is idling at a low speed. In such a scenario, method 300 may monitor engine speed and, upon detecting a low engine speed condition, open the control valve in the bypass line. Once the engine speed climbs above a preselected threshold speed, the bypass line may close. Thus, above the preselected threshold speed, all of the engine oil is circulated to the oil sump, so that only the oil sump supplies engine oil to the low pressure side of the oil pump.

For similar reasons, in another scenario, method 300 may operate the bypass line responsive to an engine load parameter Upon detecting a low engine load condition, method 300 may open the control valve in the bypass line so that oil is circulated to the low pressure side of the oil pump without passing through the oil sump. Once the engine load climbs above a preselected threshold load, the bypass line may close, so that all of the engine oil is circulated to the oil sump, and so that only the oil sump supplies engine oil to the low pressure side of the oil pump.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method, comprising:

supplying engine oil from a higher pressure oil pump side to reciprocating engine components in a block and then an engine head;

comparing one or more temperature signals to ambient temperatures to determine relative ambient temperatures;

at higher relative ambient temperatures, diverting engine oil downstream of the reciprocating engine components around an oil sump to a lower pressure oil pump side via a bypass line; and at lower relative ambient temperatures, routing engine oil downstream of the reciprocating engine components to the oil sump.

2. The method of claim 1, wherein the higher relative ambient temperatures include conditions in which one or more measured temperatures are lower than an ambient temperature and wherein the lower relative ambient temperatures include conditions in which one or more measured temperatures are higher than an ambient temperature.

3. The method of claim 2, wherein the one or more measured temperatures include an engine temperature.

4. The method of claim 2, further comprising, at the lower relative ambient temperatures, routing engine oil downstream of the reciprocating engine components to the oil sump via a return line separate from the bypass line.

5. The method of claim 1, wherein the diverting and routing are further responsive to determined first and second conditions, respectively, wherein the first determined condition is a lower engine speed condition and wherein the second determined condition is a higher engine speed condition.

6. The method of claim 1, wherein during the higher relative ambient temperatures both the oil sump and the bypass line deliver engine oil to the lower pressure oil pump side and wherein during the lower relative ambient temperatures, only the oil sump delivers engine oil to the lower pressure oil pump side.

7. The method of claim 1, wherein the diverting and routing are further responsive to determined first and second conditions, respectively, wherein the first determined condition is a lower load condition and wherein the second determined condition is a higher load condition.

8. The method of claim 1, further comprising, during the higher relative ambient temperatures, heating a portion of the engine oil supplied to the reciprocating engine components with heat from an engine coolant.

9. A system for heating engine oil, the system comprising:

an engine comprising reciprocating engine components in one or more of a cylinder block and a cylinder head of the engine;

an oil pump supplying engine oil from a higher pressure side of the oil pump to the reciprocating engine components;

a bypass line bypassing an oil sump, the bypass line including:

a bypass line inlet fluidly coupled to the engine downstream of the reciprocating engine components, a bypass line outlet fluidly coupled to a lower pressure side of the oil pump, and a valve; and an engine controller, the engine controller comprising instructions stored in memory and executed on a processor to:

compare one or more temperature signals with ambient temperatures to determine whether the engine satisfies a first condition or a second condition, the first condition comprising the one or more temperature signals being lower than an ambient temperature and the second condition comprising the one or more temperature signals being higher than the ambient temperature, at the first condition, open the valve to divert a portion of the engine oil from the bypass line inlet to the bypass line outlet, and at the second condition, close the valve.

10. The system of claim 9, further comprising an oil cooler that receives engine oil from the higher pressure side of the oil pump and supplies engine oil to the reciprocating engine components.

11. The system of claim 10, wherein the oil cooler supplies heat from an engine coolant to the engine oil during the first condition.

12. The system of claim 11, further comprising a recycle loop, the recycle loop comprising:

a recycle loop inlet coupled to the higher pressure side of the oil pump upstream of the oil cooler;

a recycle loop outlet coupled to the lower pressure side of the oil pump; and an overpressure valve.

13. The system of claim 9, wherein engine oil from the higher pressure side of the oil pump is supplied to the cylinder block of the engine before being supplied to the cylinder head of the engine, and wherein the bypass line inlet is coupled to the cylinder head of the engine.

14. The system of claim 9, wherein engine oil from the higher pressure side of the oil pump is supplied to the cylinder head of the engine before being supplied to the cylinder block of the engine, and wherein the bypass line inlet is coupled to the cylinder block of the engine.

* * * * *